US009454882B2

(12) United States Patent
Nye et al.

(10) Patent No.: US 9,454,882 B2
(45) Date of Patent: Sep. 27, 2016

(54) VERIFYING OCCUPANCY OF A BUILDING

(71) Applicant: Vivint, Inc., Provo, UT (US)

(72) Inventors: James E. Nye, Alpine, UT (US); Jeremy B. Warren, Draper, UT (US)

(73) Assignee: Vivint, Inc., Provo, UT (US)

( * ) Notice: Subject to any disclaimer, the term of this patent is extended or adjusted under 35 U.S.C. 154(b) by 27 days.

(21) Appl. No.: 14/316,597

(22) Filed: Jun. 26, 2014

(65) Prior Publication Data

US 2015/0379836 A1 Dec. 31, 2015

(51) Int. Cl.

| | |
|---|---|
| ***G08B 13/00*** | (2006.01) |
| ***G08B 13/04*** | (2006.01) |
| ***G08B 13/16*** | (2006.01) |
| ***G08B 29/18*** | (2006.01) |

(52) U.S. Cl.

CPC ..... *G08B 13/04* (2013.01); *G08B 13/1672* (2013.01); *G08B 29/188* (2013.01)

(58) Field of Classification Search

CPC G08B 19/005; G08B 25/008; G08B 27/003; G08B 29/185; G08B 7/066; G08B 25/002; G08B 21/02; G08B 21/22; G08B 25/009; G08B 25/016; G08B 29/181; G08B 13/19; G08B 17/00; G08B 17/06; G08B 21/042

USPC ..... 340/565, 425.5, 577, 566, 603, 501, 340/517, 521, 541

See application file for complete search history.

(56) References Cited

U.S. PATENT DOCUMENTS

| | | | | |
|---|---|---|---|---|
| 6,134,303 | A | 10/2000 | Chen | |
| 6,204,760 | B1 | 3/2001 | Brunius | |
| 6,215,404 | B1 | 4/2001 | Morales | |
| 2004/0151282 | A1 | 8/2004 | Jones, III et al. | |
| 2006/0028334 | A1* | 2/2006 | Adonailo | G08B 13/04 340/522 |
| 2007/0096927 | A1 | 5/2007 | Albert | |
| 2007/0183604 | A1* | 8/2007 | Araki | G10L 17/26 381/58 |
| 2010/0164732 | A1* | 7/2010 | Wedig | G08B 7/066 340/577 |
| 2012/0050021 | A1* | 3/2012 | Rao | B60N 2/002 340/425.5 |
| 2012/0062123 | A1* | 3/2012 | Jarrell | H05B 37/0245 315/131 |
| 2012/0275610 | A1* | 11/2012 | Lambert | G10L 25/48 381/56 |

OTHER PUBLICATIONS

International Search Report and Written Opinion of the International Searching Authority for PCT/US2015/035119, Aug. 31, 2015.

* cited by examiner

*Primary Examiner* — Daniel Previl
(74) *Attorney, Agent, or Firm* — Holland & Hart LLP

(57) ABSTRACT

A method for detecting occupancy of a building is described. In one embodiment, the method includes using a microphone to monitor for sounds at a building, detecting a sound via the microphone, and determining whether the sound is made by a human or made by an animal. In some cases, the microphone is a glass break sensor microphone.

12 Claims, 6 Drawing Sheets

VERIFYING OCCUPANCY OF A BUILDING

BACKGROUND

Advancements in media delivery systems and data-related technologies continue to increase at a rapid pace. Increasing demand for accessible data has influenced the advances made to data-related technologies. Computer systems have increasingly become an integral part of data creation, data usage, and data storage. Computer systems may be used to carry out several data-related functions. The widespread access to data has been accelerated by the increased use of computer networks, including the Internet and cloud networking.

Many homes and businesses use one or more computer networks to generate, deliver, and receive data and information between the various computers connected to computer networks. Users of computer technologies continue to demand increased access to information and an increase in the efficiency of these technologies. Improving the efficiency of computer technologies is desirable to those who use and rely on computers.

With the widespread use of computers and mobile devices has come an increased presence of and continued advancements in building and residential automation, and building and residential security products and systems. For example, advancements in mobile devices allow users to monitor a home or business from anywhere in the world. Nevertheless, benefits may be realized by providing systems and methods for improving automation and security systems.

SUMMARY

According to at least one embodiment, a method for detecting occupancy of a building is described. In one embodiment, the method may include using a microphone to monitor for sounds at a building, detecting a sound via the microphone, and determining whether the sound is made by a human or made by a pet. In some cases, the microphone may be a glass break sensor microphone.

In some embodiments, the method may include identifying a human footstep from the sound, identifying a human voice from the sound, identifying an animal footstep from the sound, and/or identifying an animal sound from the sound. In some cases, the method may include detecting a triggering of a motion sensor and analyzing the sound in relation to the triggering of the motion sensor. Upon detecting the triggering of the motion sensor and determining the sound is made by a pet, the method may include ignoring the triggering of the motion sensor. Upon detecting the triggering of the motion sensor and determining the sound is made by a human, the method may include triggering an alarm. In some embodiments, the method include determining whether the sound originates within the building or outside the building.

A computing device configured for detecting occupancy of a building is also described. The computing device may include a processor and memory in electronic communication with the processor. The memory may store computer executable instructions that when executed by the processor cause the processor to perform the steps of using a microphone to monitor for sounds at a building, detecting a sound via the microphone, and determining whether the sound is made by a human or made by a pet. In some cases, the microphone may be a glass break sensor microphone.

A non-transitory computer-readable storage medium storing computer executable instructions is also described. When the instructions are executed by a processor, the execution of the instructions may cause the processor to perform the steps of using a microphone to monitor for sounds at a building, detecting a sound via the microphone, and determining whether the sound is made by a human or made by a pet. In some cases, the microphone may be a glass break sensor microphone.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
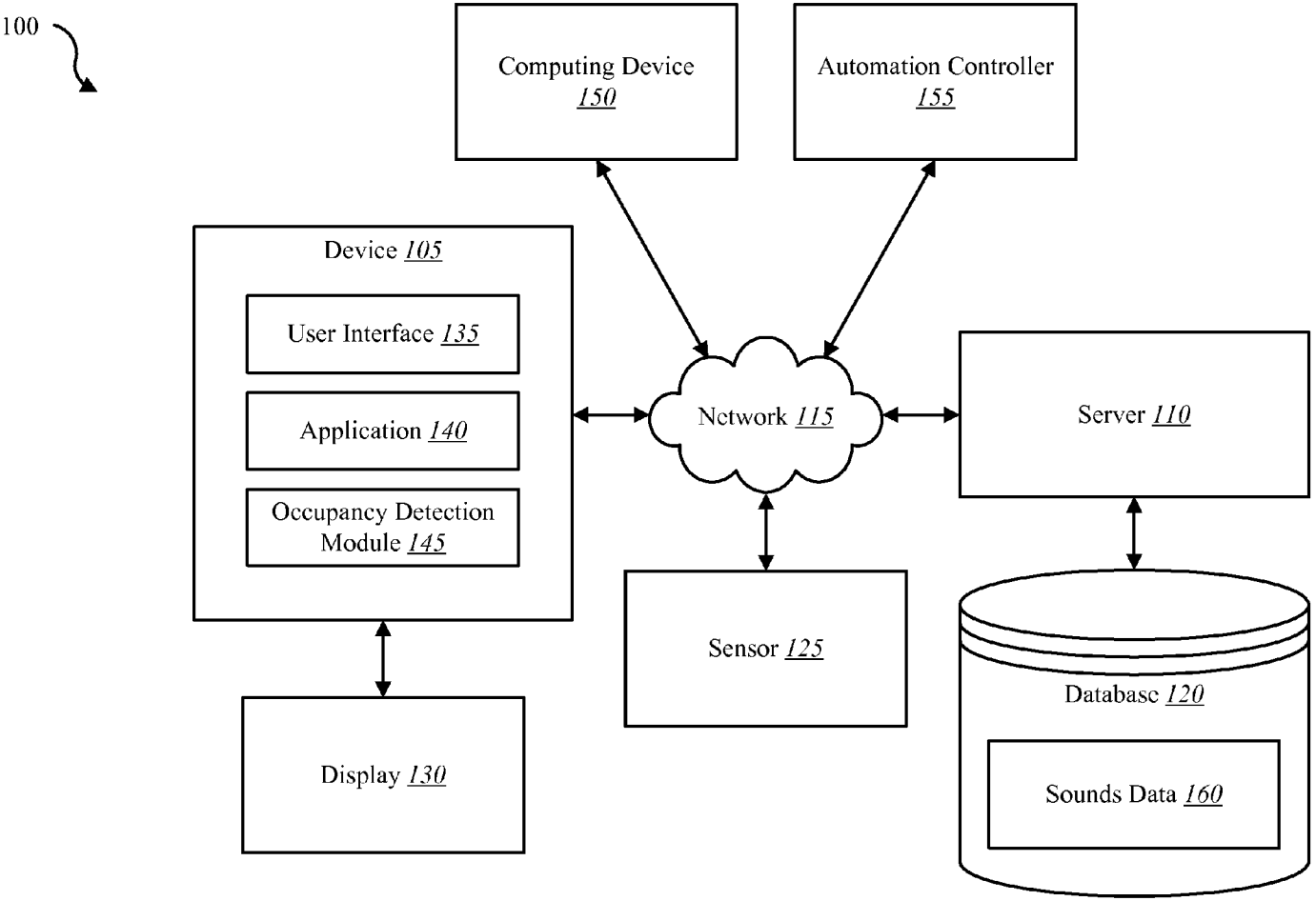
FIG. 1 is a block diagram illustrating one embodiment of an environment in which the present systems and methods may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The systems and methods described herein relate to building and residential automation and security systems. More specifically, the systems and methods described herein relate to detecting occupancy of a building in relation to a building and residential automation system. Some embodiments of the systems and methods described herein relate to detecting occupancy of a building in relation to a glass break sensor of a building or residential automation/security service.

A glass break sensor or glass break detector may be a sensor used in automation and/or security systems configured to detect when a pane of glass is shattered or broken. Glass break detectors may be used near glass doors or glass store-front windows to detect if an intruder breaks the glass to enter the premises. In some cases, glass break detectors may use a microphone. The microphone may monitor noises and vibrations in relation to a pane of glass. If the sounds or vibrations exceed a certain threshold the sounds or vibrations may be analyzed by detector circuitry. In some cases, glass break detectors may use narrowband microphones tuned to frequencies typical of glass shattering. These narrowband microphones may be configured to react to sounds above a certain threshold. In some cases, the glass break detector may compare analysis of a detected sound to one or more glass break profiles using signal transforms similar to discrete cosine transforms (DCTs) and/or fast Fourier transforms (FFTs). Such glass break detectors may react if both the amplitude threshold and statistically expressed similarity threshold are satisfied.

In some cases, glass break detectors may be located in an area of a home or business where people and/or animals may pass through. Such a glass break detector may monitor for sounds generated by passing people and/or animals. For example, a glass break detector may be mounted near a window located relative to a family room of a home. Such a home may include a number of human occupants and a pet. Glass break detectors may detect sounds generated by both the occupants as well as the pet. Thus, according to the systems and methods described herein, a glass break detector may be configured to identify human-generated sounds and animal-generated sounds. Just as the sounds and vibrations of the glass of the window are analyzed in relation to glass break profiles using signal transforms similar to DCTs and/or FFTs, the sounds generated by passing occupants and/or pets may be analyzed in relation to human and pet sound profiles. The glass break sensor may be configured to distinguish between human speech and animal sounds (e.g., dog bark, cat meow, etc.), as well as distinguish between human footsteps and animal footsteps (e.g., distinguish between biped footstep patterns and quadruped footstep patterns, etc.). Thus, according to the systems and methods described herein, such a glass break sensor may be configured to identify sounds as being human-generated sounds and/or to identify sounds as being animal-generated sounds.

FIG. 1 is a block diagram illustrating one embodiment of an environment 100 in which the present systems and methods may be implemented. In some embodiments, the systems and methods described herein may be performed on a device (e.g., device 105). As depicted, the environment 100 may include a device 105, server 110, a sensor 125, a display 130, a computing device 150, an automation controller 155, and a network 115 that allows the device 105, the server 110, the computing device 150, automation controller 155, and sensor 125 to communicate with one another.

Examples of the device 105 may include any combination of a microphone, a glass break sensor, mobile devices, smart phones, personal computing devices, computers, laptops, desktops, servers, media content set top boxes, satellite set top boxes, cable set top boxes, DVRs, personal video recorders (PVRs), etc. In some cases, device 105 may include a building automation controller integrated within device 105, or as depicted, may be in communication with an automation controller via network 115. Examples of the automation controller 155 may include any device configured to control a building such as a home, a business, a government facility, etc. Accordingly, examples of automation controller 155 include any combination of a dedicated building automation computing device (e.g., wall-mounted controller), a personal computing device (e.g., laptop, desktop, etc.), a mobile computing device (e.g., tablet computing device, smartphone, etc.), and the like. Examples of computing device 150 may include any combination of a mobile computing device, a laptop, a desktop, a server, a media set top box, etc. Examples of server 110 may include any combination of a data server, a cloud server, a server associated with an automation service provider, proxy server, mail server, web server, application server, database server, communications server, file server, home server, mobile server, name server, etc.

Examples of sensor 125 may include any combination of a camera sensor, audio sensor, forced entry sensor, shock sensor, proximity sensor, boundary sensor, light beam sensor, three-dimensional (3-D) sensor, motion sensor, smoke sensor, glass break sensor, door sensor, window sensor, carbon monoxide sensor, accelerometer, global positioning system (GPS) sensor, Wi-Fi positioning system sensor, capacitance sensor, radio frequency sensor, near-field sensor, temperature sensor, heartbeat sensor, breathing sensor, oxygen sensor, carbon dioxide sensor, brain wave sensor, movement sensor, voice sensor, other types of sensors, actuators, or combinations thereof. Sensor 125 may represent one or more separate sensors or a combination of two or more sensors in a single device. For example, sensor 125 may represent one or more camera sensors and one or more motion sensors connected to environment 100. Sensor 125 may be integrated with an identity detection system such as a facial recognition system and/or a voice recognition system. Although sensor 125 is depicted as connecting to device 105 over network 115, in some embodiments, sensor 125 may connect directly to or within device 105.

Additionally, or alternatively, sensor 125 may be integrated with a home appliance or fixture such as a light bulb fixture. Sensor 125 may include an accelerometer to enable sensor 125 to detect a movement. For example, sensor 125 may be carried by an occupant. Sensor 125 may include a wireless communication sensor 125 configured to send and receive data and/or information to and from one or more devices in environment 100. Additionally, or alternatively, sensor 125 may include a GPS sensor to enable sensor 125 to track a location of sensor 125 attached to an occupant and/or object. Sensor 125 may include a proximity sensor to enable sensor to detect a proximity of a person relative to an object to which the sensor is attached and/or associated. In some embodiments, sensor 125 may include a forced entry sensor (e.g., shock sensor, glass break sensor, etc.) to enable sensor 125 to detect an attempt to enter an area by force. Sensor 125 may include a siren to emit one or more frequencies of sound (e.g., an alarm).

In some configurations, the device 105 may include a user interface 135, application 140, and occupancy detection module 145. Although the components of the device 105 are depicted as being internal to the device 105, it is understood that one or more of the components may be external to the device 105 and connect to device 105 through wired and/or wireless connections. In some embodiments, application 140 may be installed on computing device 150 in order to allow a user to interface with a function of device 105, occupancy detection module 145, automation controller 155, and/or server 110. In some cases, user interface 135 enables a user to interface with occupancy detection module 145, to configure settings in relation to the functions of occupancy detection module 145, configure a profile, configure sound signatures, capture sound samples, and the like.

In some embodiments, device 105 may communicate with server 110 via network 115. Examples of network 115 may include any combination of cloud networks, local area networks (LAN), wide area networks (WAN), virtual private networks (VPN), wireless networks (using 802.11, for example), cellular networks (using 3G and/or LTE, for example), etc. In some configurations, the network 115 may include the Internet. It is noted that in some embodiments, the device 105 may not include an occupancy detection module 145. For example, device 105 may include application 140 that allows device 105 to interface with automation controller 155 via occupancy detection module 145 located on another device such as computing device 150 and/or server 110. In some embodiments, device 105, automation controller 155, and server 110 may include an occupancy detection module 145 where at least a portion of the functions of occupancy detection module 145 are performed separately and/or concurrently on device 105, automation controller 155, and/or server 110. Likewise, in some embodiments, a user may access the functions of device 105 and/or automation controller 155 (directly or through device 105 via occupancy detection module 145) from computing device 150. For example, in some embodiments, computing device 150 includes a mobile application that interfaces with one or more functions of device 105, automation controller 155, occupancy detection module 145, and/or server 110.

In some embodiments, server 110 may be coupled to database 120. Database 120 may be internal or external to the server 110. In one example, device 105 may be coupled directly to database 120 or a database similar to database 120. Thus, database 120 may be internal or external to device 105. Database 120 may include sounds data 160. In some cases, device 105 may access sounds data 160 in database 120 over network 115 via server 110. Sounds data 160 may include data regarding algorithms for identifying sounds (e.g., signal transforms such as DCTs, FFTs, etc.) such as algorithms for detecting human voice patterns, algorithms for detecting human footsteps, algorithms for detecting animal sounds, algorithms for detecting animal footsteps, etc. For instance, sounds data 160 may include algorithms for distinguishing between footsteps of bipeds (e.g., humans) and quadrupeds (e.g., a pet dog, a pet cat, etc.). Sounds data 160 may include human speech signatures, human footstep signatures, signatures for one or more animals sounds (e.g., dog bark, cat meow, bird chirp, etc.). Thus, in some cases, a sound detected in the building may be compared to a signature stored in database 120, and upon detecting a match, identifying the source of the sound as human and/or from a pet. In some cases, sounds data 160 may include samples of human speech, samples of animal sounds, and the like. In some cases, sounds data 160 may include samples taken from an occupant of a building and/or samples of a pet of a building, etc. Accordingly, occupancy detection module 145, in conjunction with sounds data 160, may enable the detection of occupancy of a building in relation to detected events in an automation/security system. In some embodiments, occupancy detection module 145 may perform the systems and methods described herein in conjunction with user interface 135 and/or application 140. Further details regarding the occupancy detection module 145 are discussed below.

Figure 2:
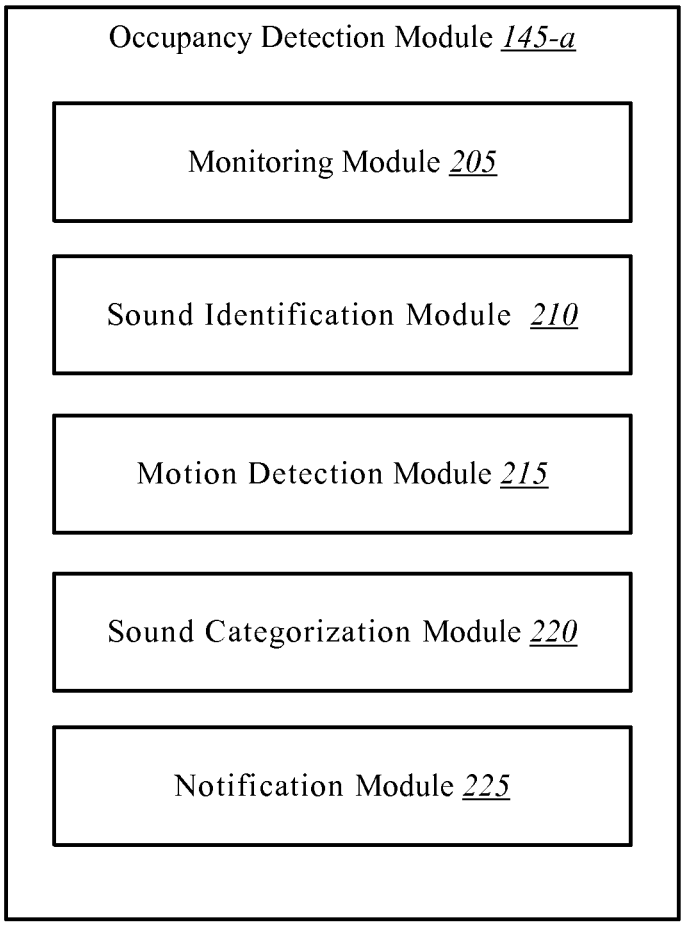
FIG. 2 is a block diagram illustrating one example of an occupancy detection module.

FIG. 2 is a block diagram illustrating one example of an occupancy detection module 145-*a*. Occupancy detection module 145-*a* may be one example of occupancy detection module 145 depicted in FIG. 1. As depicted, occupancy detection module 145-*a* may include monitoring module 205, a sound identification module 210, a motion detection module 215, a sound categorization module 220, and a notification module 225.

In one embodiment, monitoring module 205 may use a microphone to monitor for sounds at a building. In some embodiments, the microphone may be a glass break sensor microphone. The building may be any sort of residence, including a home, apartment, condo, etc. In some cases, the occupancy detection module 145-*a* may be located in a non-residential building such as a place of business, an office, a school, a church, a museum, a warehouse, a government facility, and the like. In some embodiments, occupancy detection module 145-*a* may be located in relation to any location with glass windows, such as a vehicle. Thus, in some cases monitoring module 205 may monitor for sounds of humans and/or pets passing by a vehicle.

Accordingly, monitoring module 205 may be configured to detect a sound via the microphone of a glass break sensor. The sound may be generated from any number of sources. In some cases, the sound may be generated by a human and/or an animal. Sound identification module 210 may determine whether the sound is made by a human or made by a pet. Sound identification module 210 may be configured to analyze a detected sound in relation to a variety of sound profiles (e.g., glass break profiles, human sound profiles, animal sound profiles, etc.). Sound identification module 210 may use digital signal processing to distinguish between various sound profiles. For example, sound identification module 210 may use signal transforms such as and/or similar to DCTs and/or FFTs to analyze and distinguish between the detected sounds. In some cases, sound identification module 210 may generate sound signatures based on recorded samples of generic humans and/or generic animals. In some embodiments, sound identification module 210 may use bipedal and quadrupedal sound profiles to distinguish between and/or identify human and animal footsteps.

In one example, sound identification module 210 may be configured to generate customized sound signatures of occupants and/or pets of a building (e.g., recorded samples of human speech, human footsteps, animal sounds, and/or animal footsteps). Sound identification module 210 may compare sound profiles and/or sound signatures to detected sounds in order to identify a source of the sound. Thus, in some cases, sound identification module 210 may be configured to detect the identity of the source of the sound. Upon detecting the identity of an occupant of a building, the notification module 225 may log the detected identity of the pet in a database. Upon failing to determine the identity of a detected human, the notification module 225 may log the undetected identity of the pet in a database as "unknown." Additionally, based on detecting an unknown human, an alarm may be triggered based on the settings of the automation/security system (e.g., armed at night, armed away, etc.). Upon detecting a sound of a pet, the notification module 225 may log the detected identity of the pet in a database. Thus, sound identification module 210 may be configured to identify a human footstep from the sound, identify a human voice from the sound, identify an animal footstep from the sound, and/or identify an animal sound from the detected sound.

In addition to detecting individual human and individual animal sounds, sound identification module 210 may detect sounds from a human and an animal simultaneously and distinguish between the overlapping sounds to detect both human and animal sounds. In some embodiments, sound identification module 210 may determine whether the sound originates from within a building or outside the building. Thus, sound identification module 210 may detect a human and/or animal sounds originating outside a building window. Additionally, sound identification module 210 may detect human and/or animals sounds originating inside a building near the window. Thus, with an alarm set such as at night, a motion sensor may detect motion in relation to a building. In conjunction with the motion sensor, the occupancy detection module 145-*a* may determine that a human is passing by the outside of a building's window based on a sound generated by the human matches a human sound profile.

Thus, occupancy detection module 145-*a* may enhance the detection capabilities of a conventional automation/security system.

In some embodiments, motion detection module 215 may detect a triggering of a motion sensor and sound categorization module 220 may analyze the sound in relation to the triggering of the motion sensor. Upon detecting the triggering of the motion sensor and determining a detected the sound is made by an animal (e.g., a pet dog, cat, etc.), motion detection module 215 may ignore the triggering of the motion sensor. Thus, upon detecting a motion signature of a pet, motion detection module 215 may confirm that the detected motion originates from a pet based on the detected sounds. Accordingly, notification module 225 may forego generating a notification. Upon detecting the triggering of the motion sensor and determining the sound is made by a human, motion detection module 215 may trigger an alarm. For example, upon arming a system for night, a motion sensor may detect a motion signature of a human. Motion detection module 215 may confirm that the detected motion originates from a human based on the detected sounds. Accordingly, notification module 225 may generate a notification (e.g., a notification for a security monitoring company, a notification for a police department, a notification for an occupant, etc.).

Figure 3:
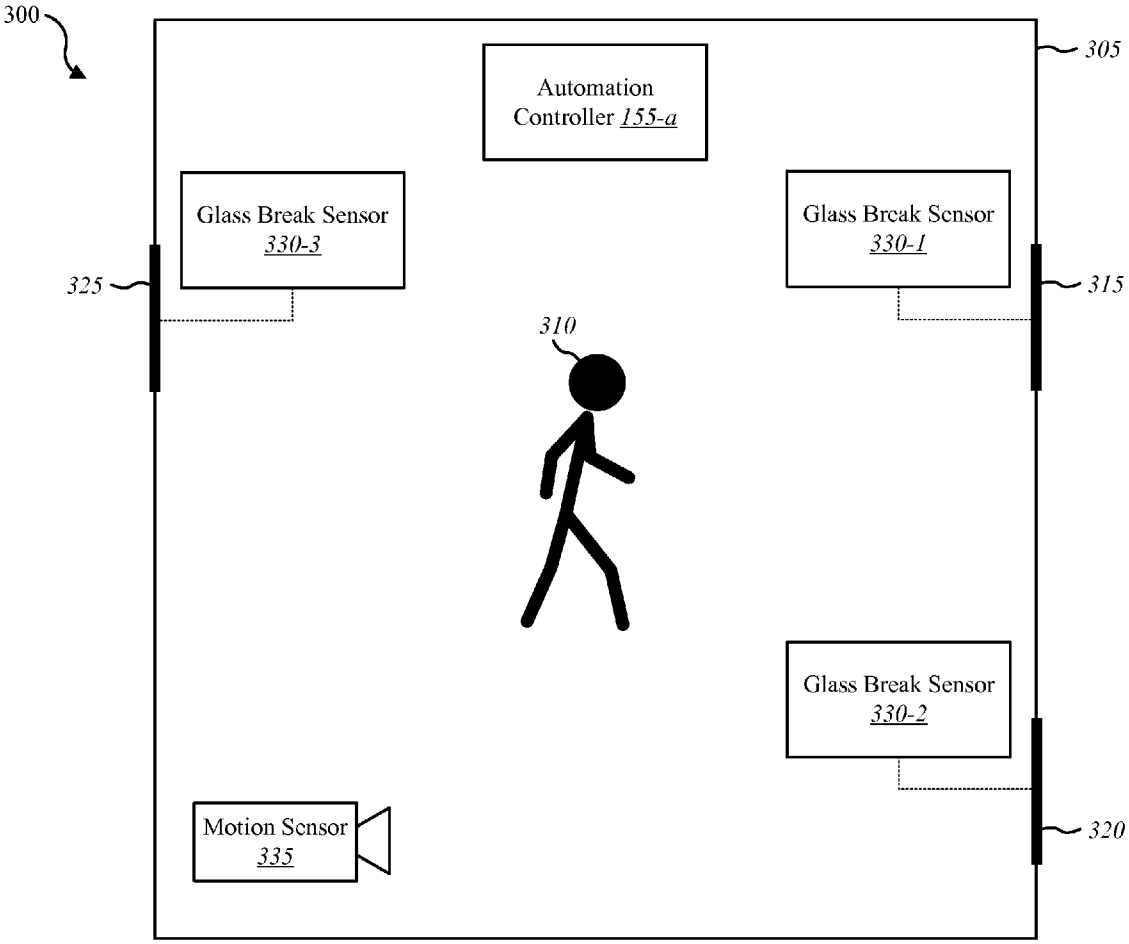
FIG. 3 is a block diagram illustrating one example of an environment for detecting occupancy of a building to improve awareness regarding detected events.

FIG. 3 is a block diagram illustrating one example of an environment 300 for detecting occupancy of a building to improve the timely notification regarding the detection of events. As depicted, environment 300 may include a building 305. The building 305 may include windows 315, 320, and 325. In addition to automation controller 155-*a*, glass break sensors 330-1, 330-2, 330-3 may be located within building 305. Automation controller 155-*a* may be configured to control an automation/security system of building 305. In some cases, automation controller 155-*a* and/or glass break sensors 330 may operate in conjunction with occupancy detection module 145. As depicted, glass break sensors 330-1 may be installed in relation to window 315, glass break sensors 330-2 may be installed in relation to window 320, and glass break sensors 330-3 may be installed in relation to window 325. Additionally, building 305 may include a motion sensor 335.

As depicted, a person 310 may be inside the building 305. Motion sensor 335 may detect the motion of person 310 moving through building 305. Additionally, the person 310 may generate sounds from human speech and/or human footsteps. The sounds generated by the person 310 may be detected by microphones on glass break sensors 330. The sounds detected by glass break sensors 330 may be analyzed to determine that the detected sounds are generated by a human (i.e., person 310). Accordingly, based on the state of the security system of building 305 automation controller 155-*a* may trigger an alarm. For example, a state of "armed stay" (e.g., armed with motion sensors disabled) and "disarmed" may not trigger an alarm upon detecting sounds generated by person 310, but "armed away" and "armed night" may trigger an alarm upon person 310 triggering motion sensor 335 and glass break sensors 330 detecting sounds from person 310. In some cases, automation controller 155-*a* and/or glass break sensors 330 may use passive acoustic location in order to determine a location of person 310 relative to the glass break sensors 330.

Figure 4:
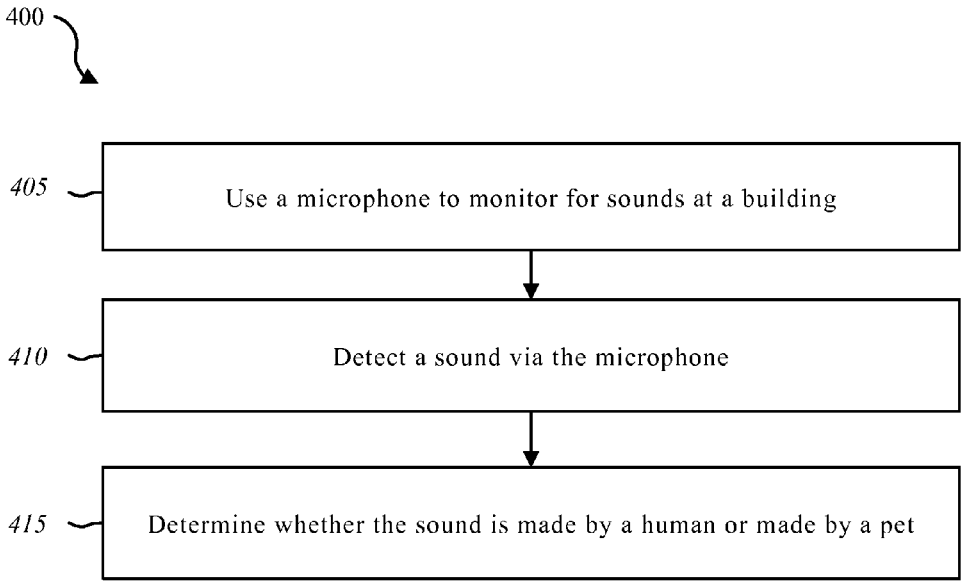
FIG. 4 is a flow diagram illustrating one embodiment of a method for detecting occupancy of a building.

FIG. 4 is a flow diagram illustrating one embodiment of a method 400 for detecting occupancy of a building. In some configurations, the method 400 may be implemented by the occupancy detection module 145 illustrated in FIGS. 1 and/or 2. In some configurations, the method 400 may be implemented in conjunction with the application 140 and/or the user interface 135 illustrated in FIG. 1.

At block 405, a microphone may be used to monitor for sounds at a building. At block 410, a sound may be detected via the microphone. At block 415, it may be determined whether the sound is made by a human or made by a pet.

Figure 5:
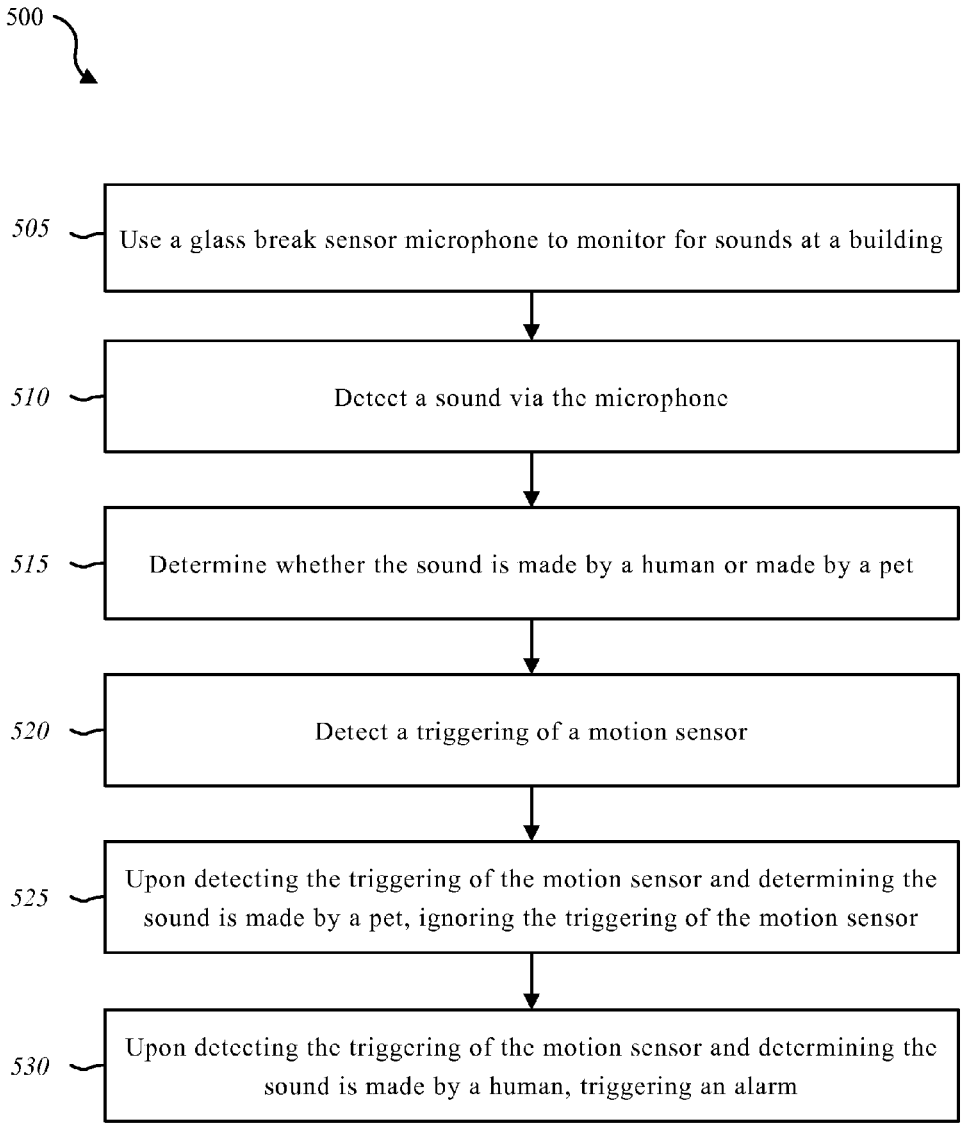
FIG. 5 is a flow diagram illustrating one embodiment of a method for detecting occupancy of a building.

FIG. 5 is a flow diagram illustrating one embodiment of a method 500 for detecting occupancy of a building. In some configurations, the method 500 may be implemented by the occupancy detection module 145 illustrated in FIG. 1 or 2. In some configurations, the method 500 may be implemented in conjunction with the application 140 and/or the user interface 135 illustrated in FIG. 1.

At block 505, a glass break sensor microphone may be used to monitor for sounds at a building. At block 510, a sound may be detected via the glass break sensor microphone. At block 515, it may be determined whether the sound is made by a human or made by a pet. At block 520, a triggering of a motion sensor may be detected. At block 525, upon detecting the triggering of the motion sensor and determining the sound is made by a pet, the triggering of the motion sensor may be ignored. At block 530, upon detecting the triggering of the motion sensor and determining the sound is made by a human, an alarm may be triggered.

Figure 6:
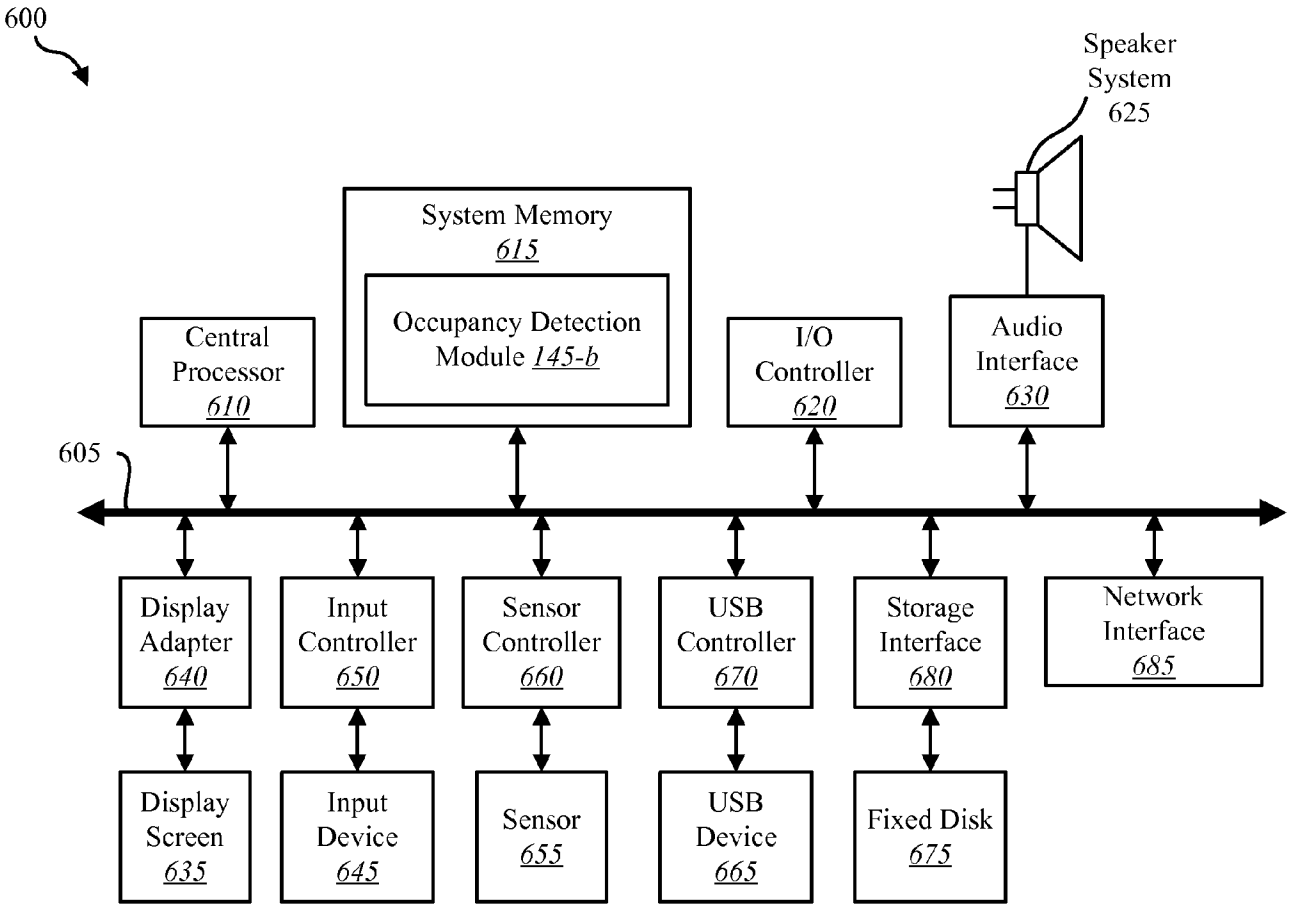
FIG. 6 depicts a block diagram of a computer system suitable for implementing the present systems and methods.

FIG. 6 depicts a block diagram of a controller 600 suitable for implementing the present systems and methods. The controller 600 may be an example of device 105, computing device 150, and/or automation controller 155 illustrated in FIG. 1. In one configuration, controller 600 includes a bus 605 which interconnects major subsystems of controller 600, such as a central processor 610, a system memory 615 (typically RAM, but which may also include ROM, flash RAM, or the like), an input/output controller 620, an external audio device, such as a speaker system 625 via an audio output interface 630, an external device, such as a display screen 635 via display adapter 640, an input device 645 (e.g., remote control device interfaced with an input controller 650), multiple USB devices 665 (interfaced with a USB controller 670), and a storage interface 680. Also included are at least one sensor 655 connected to bus 605 through a sensor controller 660 and a network interface 685 (coupled directly to bus 605).

Bus 605 allows data communication between central processor 610 and system memory 615, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the occupancy detection module 145-*b* to implement the present systems and methods may be stored within the system memory 615. Applications (e.g., application 140) resident with controller 600 are generally stored on and accessed via a non-transitory computer readable medium, such as a hard disk drive (e.g., fixed disk 675) or other storage medium. Additionally, applications can be in the form of electronic signals modulated in accordance with the application and data communication technology when accessed via interface 685.

Storage interface 680, as with the other storage interfaces of controller 600, can connect to a standard computer readable medium for storage and/or retrieval of information, such as a fixed disk drive 675. Fixed disk drive 675 may be a part of controller 600 or may be separate and accessed through other interface systems. Network interface 685 may provide a direct connection to a remote server via a direct network link to the Internet via a POP (point of presence). Network interface 685 may provide such connection using wireless techniques, including digital cellular telephone connection, Cellular Digital Packet Data (CDPD) connection, digital satellite data connection, or the like. In some embodiments, one or more sensors (e.g., motion sensor, smoke sensor, glass break sensor, door sensor, window sensor, carbon monoxide sensor, and the like) connect to controller 600 wirelessly via network interface 685.

Many other devices or subsystems (not shown) may be connected in a similar manner (e.g., entertainment system, computing device, remote cameras, wireless key fob, wall mounted user interface device, cell radio module, battery, alarm siren, door lock, lighting system, thermostat, home appliance monitor, utility equipment monitor, and so on). Conversely, all of the devices shown in FIG. 6 need not be present to practice the present systems and methods. The devices and subsystems can be interconnected in different ways from that shown in FIG. 6. The aspect of some operations of a system such as that shown in FIG. 6 are readily known in the art and are not discussed in detail in this application. Code to implement the present disclosure can be stored in a non-transitory computer-readable medium such as one or more of system memory 615 or fixed disk 675. The operating system provided on controller 600 may be iOS®, ANDROID®, MS-DOS®, MS-WINDOWS®, OS/2®, UNIX®, LINUX®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A method for detecting occupancy, comprising:

using a microphone from a glass break sensor to monitor for sounds at a building, the glass break sensor being installed proximate to a pane of glass at the building and communicatively coupled to an automation and security system at the building, wherein the glass break sensor is originally dedicated to detect breaking glass;

detecting a sound via the microphone detecting a triggering of a motion sensor; analyzing the sound in relation to the triggering of the motion sensor; and determining whether the sound is made by a human or made by an animal upon determining, based on the analyzing, the sound is made by the animal; ignoring the triggering of the motion sensor; and upon detecting the triggering of the motion sensor and determining the sound is made by the human, triggering an alarm.

2. The method of claim 1, further comprising:

identifying a human footstep from the sound.

3. The method of claim 1, further comprising:

identifying a human voice from the sound.

4. The method of claim 1, further comprising:

identifying an animal footstep from the sound.

5. The method of claim 1, further comprising:

identifying an animal sound from the sound.

6. The method of claim 1, further comprising:

determining whether the sound originates within the building or outside the building.

7. A microphone configured for detecting occupancy, comprising:

a processor;

memory in electronic communication with the processor, wherein the memory stores computer executable instructions that when executed by the processor cause the processor to perform the steps of:

monitoring for sounds at a building using the microphone, the microphone being from a glass break sensor, the glass break sensor being installed proximate to a pane of glass at the building and communicatively coupled to an automation and security system at the building, wherein the glass break sensor is originally dedicated to detect breaking glass;

detecting a sound via the microphone 3 detecting a triggering of a motion sensor; analyzing the sound in relation to the triggering of the motion sensor; and determining whether the sound is made by a human or made by an animal, the microphone being part of the home automation and security system; upon determining, based on the analyzing, the sound is made by the animal, ignoring the triggering of the motion sensor; and upon detecting the triggering of the motion sensor and determining the sound is made by the human, triggering an alarm.

8. The microphone of claim 7, wherein the instructions executed by the processor cause the processor to perform the steps of:

identifying a human footstep from the sound.

9. The microphone of claim 7, wherein the instructions executed by the processor cause the processor to perform the steps of:

identifying a human voice from the sound.

10. The microphone of claim 7, wherein the instructions executed by the processor cause the processor to perform the steps of:

identifying an animal footstep from the sound.

11. The microphone of claim 7, wherein the instructions executed by the processor cause the processor to perform the steps of:

identifying an animal sound from the sound.

12. A non-transitory computer-readable storage medium storing computer executable instructions that when executed by a processor cause the processor to perform the steps of:

using a microphone from a glass break sensor to monitor for sounds at a building, the glass break sensor being installed proximate to a pane of glass at the building and communicatively coupled to an automation and security system at the building, wherein the glass break sensor is originally dedicated to detect breaking glass;

detecting a sound via the microphone detecting a triggering of a motion sensor; analyzing the sound in relation to the triggering of the motion sensor; and determining whether the sound is made by a human or made by an animal; upon determining, based on the analyzing, the sound is made by the animal; ignoring the triggering of the motion sensor; and upon detecting the triggering of the motion sensor and determining the sound is made by the human, triggering an alarm.

* * * * *